US006398331B1

(12) United States Patent
Asaka et al.

(10) Patent No.: US 6,398,331 B1
(45) Date of Patent: Jun. 4, 2002

(54) APPARATUS FOR DRIVING A PRINTHEAD AND METHOD OF DRIVING THE PRINTHEAD

(75) Inventors: Toshiyuki Asaka; Hideaki Ishimizu; Shigeru Tsunoda; Toshiro Suemune, all of Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/498,060

(22) Filed: Feb. 4, 2000

(30) Foreign Application Priority Data

Feb. 9, 1999 (JP) ..... 11-031514

(51) Int. Cl.[7] ..... B41J 2/01
(52) U.S. Cl. ..... 347/9; 347/11; 347/14
(58) Field of Search ..... 347/9–11, 14, 347/19

(56) References Cited

U.S. PATENT DOCUMENTS 5,818,472 A * 10/1998 Usui et al. ..... 347/10
5,975,668 A * 11/1999 Fujii et al. ..... 347/10
6,109,716 A * 8/2000 Takahashi ..... 347/11
6,203,132 B1 * 3/2001 Tsukada et al. ..... 347/11

* cited by examiner

*Primary Examiner*—Craig A. Hallacher
(74) *Attorney, Agent, or Firm*—Rabin & Berdo

(57) ABSTRACT

An apparatus for driving a printhead has a timer, a power supply, and a controller. The power supply applies a drive voltage to the printhead to eject ink drops from the printhead. The timer counts an elapsed time during which the printhead does not eject ink drops. The controller performs an ejection test where the drive voltage drives the printhead a plurality of times to eject a plurality of ink drops. The controller drives the power supply to increase the drive voltage in accordance with a length of the elapsed time. The ejection test is performed at a predetermined length of the elapsed time, the drive voltage and the predetermined length of the elapsed time are selected in accordance with a decrease in an ejection speed of the ink drops. The controller controls the drive voltage such that the surface of meniscus of ink in the orifice is subjected to fine vibration before the ink drop is ejected. The surface of the meniscus is subjected to fine vibration prior to either a printing operation or an ejection test. When the ejection test is performed, the controller determines the drive voltage by adding a first correction voltage to a drive voltage required for a printing operation. When the surface of meniscus is subjected to fine vibration, the controller determines the drive voltage by adding a second correction voltage to the drive voltage.

18 Claims, 11 Drawing Sheets

FEEDING MOTOR
59
CARRIAGE MOTOR
60
PRINT-HEAD
10
1ST MOTOR DRIVER
54
2ND MOTOR DRIVER
55
HEAD DRIVER
56
VOLTAGE CONVERTER
57
POWER SUPPLY CONTROLLER
58
AC POWER
CONTROLLER
50
TABLE
53
TIMER
52
INTERFACE
51
PRINT DATA
CONTROL SIGNALS
HOST APPARATUS

APPARATUS FOR DRIVING A PRINTHEAD AND METHOD OF DRIVING THE PRINTHEAD

BACKGROUND OF THE INVENTION

1. Field of the Invention

The present invention relates to an apparatus for driving a printhead and a method of driving the printhead.

2. Description of the Related Art

One conventional printhead is a piezoelectric printhead. A piezoelectric material is polarized and then formed with a plurality of grooves therein that define ink pressure chambers. The walls that define the grooves are formed with electrodes thereon. When drive voltages are applied to the electrodes, the walls are deformed to introduce ink into the ink pressure chambers from an ink reservoir and then pressurize the ink held in the ink chambers, so that ink drops are ejected through orifices onto a print medium.

With the conventional printhead, a suction operation should be performed periodically in order to maintain the orifices not clogged. Printing cannot be performed during suction operation. Therefore, performing a suction operation is an obstacle to increasing the throughput of a printer. Ink of about several micro liters is wasted during suction operation. The amount of wasted ink increases with increasing number of times of suction operation.

SUMMARY OF THE INVENTION

The present invention was made in view of the aforementioned drawbacks of the prior art ink jet printer.

An object of the invention is to provide an apparatus for driving a printhead and a method of driving the printhead. The apparatus and method prevent poor, insufficient ejection of ink drops, increase the throughput of the printer, and reduce the amount of wasted ink.

An apparatus for driving a printhead comprises a timer, power supply, and a controller. The power supply applies a drive voltage to the printhead to eject ink drops from the printhead. The timer counts an elapsed time during which the printhead does not eject ink drops. The controller performs an ejection test where the drive voltage drives the printhead a plurality of times to eject a plurality of ink drops. The controller drives the power supply to increase the drive voltage in accordance with a length of the elapsed time.

The ejection test is performed after a predetermined length of the elapsed time. The drive voltage and the predetermined length of the elapsed time are selected in accordance with a decrease in an ejection speed of the ink drops.

The controller controls the drive voltage such that the surface of meniscus of ink in the orifice is subjected to fine vibration before the ink drop is ejected.

The surface of the meniscus is subjected to fine vibration prior to a printing operation and an ejection test.

When the ejection test is performed, the controller determines the drive voltage by adding a first correction voltage to a drive voltage required for a printing operation.

When the surface of meniscus is subjected to fine vibration, the controller determines the drive voltage by adding a second correction voltage to the drive voltage required for the printing operation.

A method of driving a printhead comprises the steps of:

driving the printhead to eject ink drops through orifices of the printhead to perform a printing operation when print data is received;

counting an elapsed time during which the printing operation is not performed; and performing an ejection test in which the printhead is driven in accordance with a length of the elapsed time.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The present invention will be described in detail with reference to the accompanying drawings.

First Embodiment

<Construction>

Figure 1:
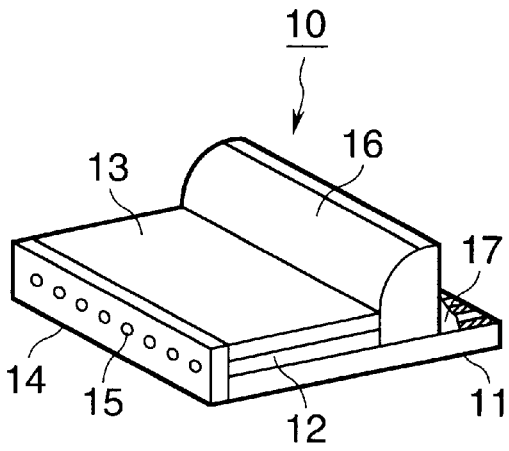
FIG. 1 is a perspective view of a piezoelectric type printhead according to the invention.

FIG. 1 is a perspective view of a piezoelectric type printhead according to the invention. A printhead 10 is constructed of a lower piezoelectric body 11, a cover 13, and an upper piezoelectric body 12 sandwiched between the lower piezoelectric body 11 and the cover 13. The upper piezoelectric body 12 is polarized. The upper piezoelectric body 12 and lower piezoelectric body 11 are formed with grooves therein, not shown, by cutting, so that the grooves define ink pressure chambers when the upper and lower piezoelectric bodies 12 and 11 are placed together one over the other. After the upper and lower piezoelectric body 12 and 11 are placed together, an orifice plate 14 is attached to a front end of the assembly of the upper and lower piezoelectric bodies 12 and 11 to close the ink pressure chambers. The orifice plate 14 is formed with orifices 15 therein through which corresponding ink pressure chambers eject ink drops. Attached to a rear end of the assembly of the upper and lower piezoelectric bodies 12 and 11 is a common ink reservoir 16 that is formed of a resin material and in communication with the respective ink pressure chambers. The rear end of the assembly is also closed by a sealing material 17. The lower piezoelectric body 11 has electrodes formed thereon corresponding to the walls of the respective ink chambers.

When a printing operation is performed, an ink tank, not shown, supplies ink by way of an ink path to the common ink reservoir 16. Then, the ink is directed from the common ink reservoir 16 to the respective ink chambers. When drive voltages are applied to the electrodes, the walls deform to compress the ink chamber in a shear mode fashion, thereby ejecting ink drops through the orifices.

Figure 2:
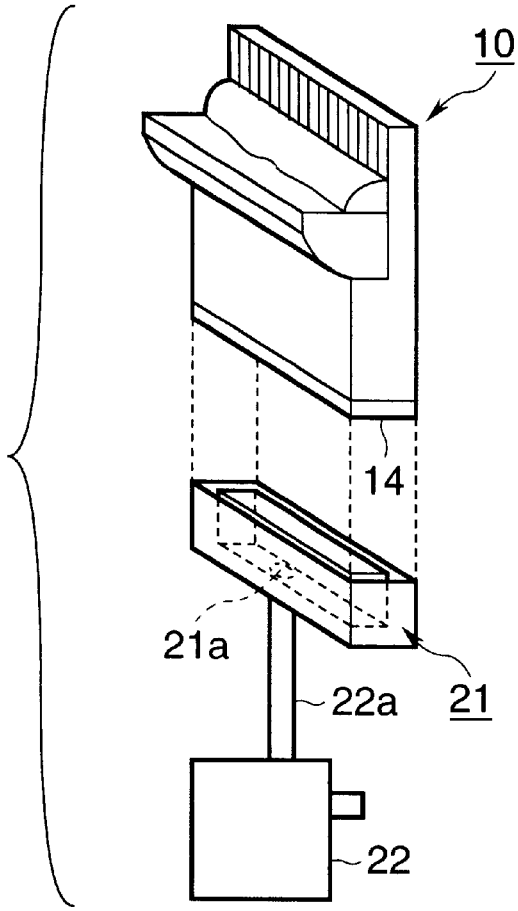
FIG. 2 is a perspective view of the printhead and a cap connected to a negative pressure source before the cap is attached to the printhead.

FIG. 2 is a perspective view of the printhead 10 and a cap 21 connected to a negative pressure source 22 before the cap 21 is attached to the printhead 10.

Figure 3:
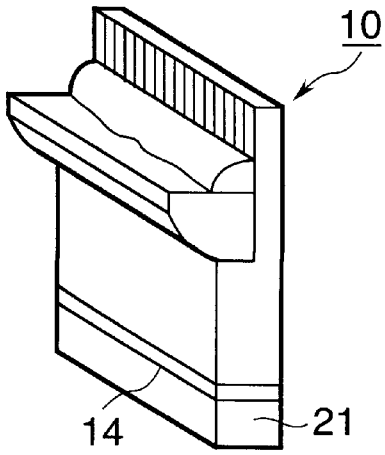
FIG. 3 is a perspective view of the printhead after the cap 21 has fitted thereto.

FIG. 3 is a perspective view of the printhead after the cap 21 has fitted thereto.

The cap 21 is made of a resin material and has a recess configured to the orifice plate 14. The bottom of the cap 21 has a hole 21*a* formed therein into which a porous rod 22*a* is connected, such that the cap 21 is in communication with the negative pressure source in the form of, for example, a pump via the porous rod 22*a*. The porous rod 22*a* is in the form of fluorine plastics or porous urethane. The other end of the porous rod 22*a* is connected to an ink basin, not shown. The ink used in the present invention is volatile ink.

Thus, as shown in FIG. 3, when a printing operation is to be performed after a predetermined long time has elapsed since a printing was performed last time, the cap 21 is fitted over the orifice plate 14 of the printhead 10 and a low negative pressure is applied to the orifices 15 by the negative pressure source 22 to facilitate ejection test_of the ink drops from the ink pressure chambers.

Figure 4:
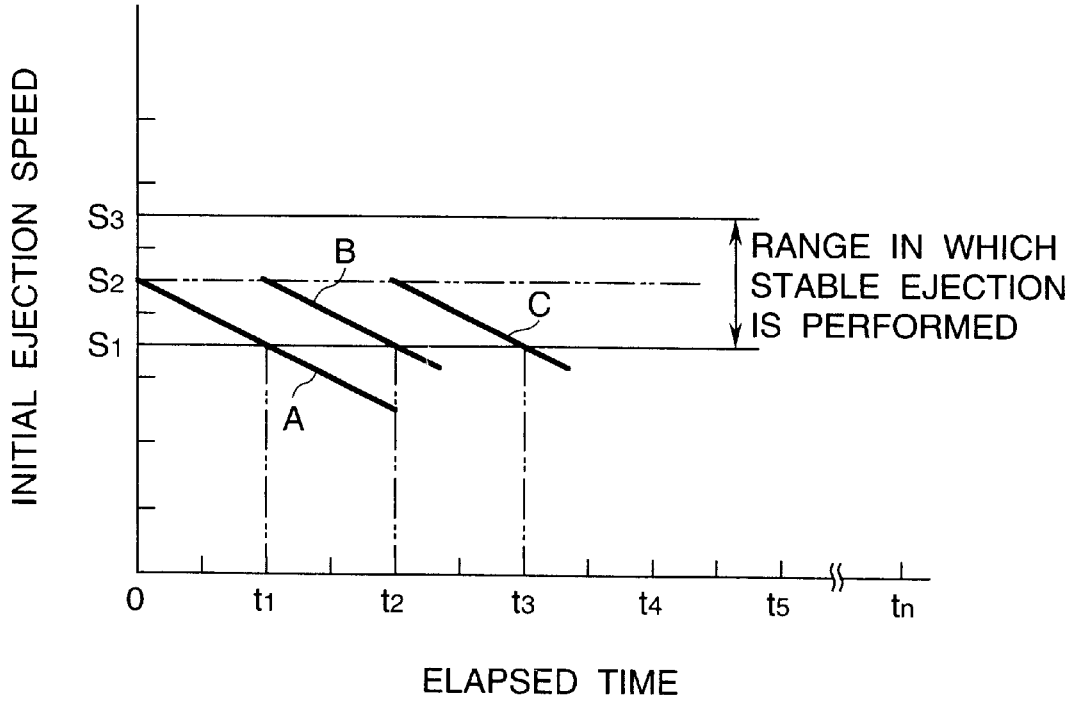
FIG. 4 is a graph illustrating the ejection performance of a printhead.

FIG. 4 is a graph illustrating ejection performance of a printhead. FIG. 4 plots elapsed time as the abscissa and initial ejection speed as the ordinate. Elapsed time is a time elapse during which no printing has been performed since a printing was performed last time. Initial ejection speed is a speed of an ink drop when an ink drop is ejected after an elapsed time. As is clear from line A, the longer the elapsed time, the lower the initial ejection speed. From line A, the initial ejection speed has decreased to s1 at time t1. However, as shown by line B, the ejection speed recovers to s2 after an ejection test has been performed shortly at time t1 to eject a sufficient number of ink drops. Likewise, as shown by line B, the initial ejection speed has decreased to s1 at time t2. However, as shown by line C, the ejection speed becomes v2 after another ejection test is performed shortly at time t2 to eject a sufficient number of ink drops. The range from s1 to s3 is a range in which normal ejection speed can be recovered if an ejection test is performed.

Figure 5:
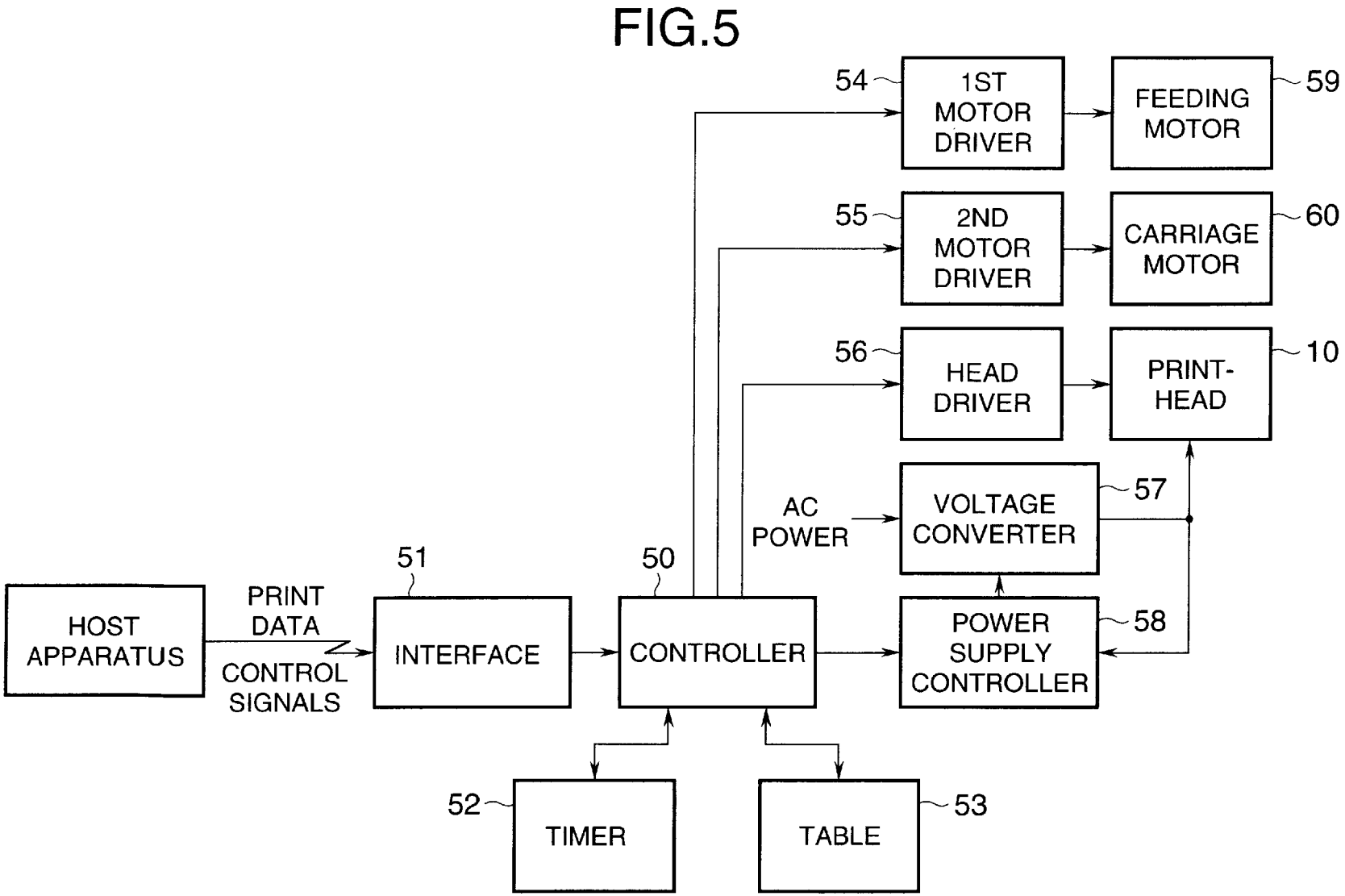
FIG. 5 is a control block diagram of the ink jet printer according to the first embodiment.

FIG. 5 is a control block diagram of the ink jet printer according to the first embodiment.

Referring to FIG. 5, a controller 50 receives print data and associated control signals through an interface 51 from a host apparatus. The controller 50 is connected to a timer 52, table 53, first and second motor drivers 54 and 55, a printhead driver 56, and power supply 58. The timer 52 counts elapsed time since the last printing. The table 53 stores various settings such as the elapsed times and drive voltages that correspond to the elapsed times. The first motor driver 54 drives a feeding motor 59. The second motor driver 55 drives a carriage motor 60. The head driver 56 drives the printhead 10. A voltage converter 57 converts the ac line voltage into a drive voltage that drives the printhead. The power supply controller 58 controls the voltage converter 57.

<Operation of Printer>

The operation of the ink jet printer will be described.

Upon power-up, the cap 21 is fitted over the orifice plate 14 of the printhead 10. Then, the controller 50 causes the negative pressure source 22 to operate, thereby performing a suction operation to suck the ink in the pressure chambers. After the suction operation, the controller 50 causes the timer 52 to start counting the elapsed time t (FIG. 1). In this invention, the suction operation is performed only shortly after power up of the printer.

Upon receiving print data from the host apparatus via the interface 51, the controller 50 drives the feeding motor 59 and the carriage motor 60 in accordance with the programs stored in a ROM, not shown, so that the feeding motor 59 feeds print paper, not shown, to a platen and the carriage motor 60 drives the carriage, not shown, to run across the print paper placed on the platen. In this manner, a printing is performed.

If the elapsed time t reaches a predetermined time t1 and the controller 50 does not receive any print data from the host apparatus, then the controller 50 causes the power supply 58 to provide pulses of drive voltage to the electrodes of the printhead, thereby causing the ink pressure chambers 10 to eject several tens to several hundred ink drops with the cap 21 remaining fitted over the orifice plate 14. Thereafter, with the cap 21 intimately fitting over the orifice plate, the controller 50 provides pulses of drive voltage, the voltage being sufficiently low not to cause ejection of ink from the ink pressure chamber but high enough to cause the ink pressure chambers to be slightly pressurized. The pulses of the drive voltage cause the surfaces of meniscuses in the orifices to vibrate.

Likewise, ejection test and vibration of meniscuses are performed every time the elapsed time reaches times t1, t2, t3, t4, t5, . . . tn (FIG. 4). The vibration of meniscuses is performed a plurality of times before ink drops are ejected during the ejection test. The timer 52 may be initially set for time t1, so that the ejection test and vibration of meniscuses are performed every time the time count reaches time t1, and then the timer 52 is reset.

The ink sucked from the orifices 15 into the cap 21 is directed through the porous member 22*a* to the ink basin. In this manner, the ejection test is effected at predetermined time intervals, thereby preventing poor ejection of ink resulting from clogging of the orifices. Since the suction operation is not performed in each ejection test, the ejection test and vibration of meniscuses are effected in a very short time. This prevents the throughput of the printer from significantly decreasing. Moreover, one ejection test consumes a very small amount of ink, i.e., a total amount of several nano liters or so. The ejection test and vibration of meniscuses are effected with the cap 21 intimately fitting to the orifice plate 14, so that the interior of the cap 21 is maintained at high humidity, allowing a longer elapsed time between adjacent ejection tests. This maintains the ejection speed within a reasonable range, so that ink drops ejected from the moving printhead are allowed to accurately land on the print paper at aimed locations.

Moreover, one ejection test wastes a very small amount of ink, i.e., several nano liters or so. The ejection test and vibration of meniscuses are effected with the cap 21 intimately fitting the orifice plate 14, so that the interior of the cap 21 can be maintained at high humidity, providing long elapsed time before the next ejection test.

Most of the ink absorbed into the porous member 22*a* is held within the porous member 22*a* and serves to maintain as constant humidity in the cap as possible. Therefore, the ink basin at the end of the porous member 22*a* is not flooded and ink ejected from the ink chambers do not soil the orifice plate.

Second Embodiment

Elements of a second embodiment similar to those of the first embodiment have been given the same reference numerals and the description thereof is omitted.

Figure 6:
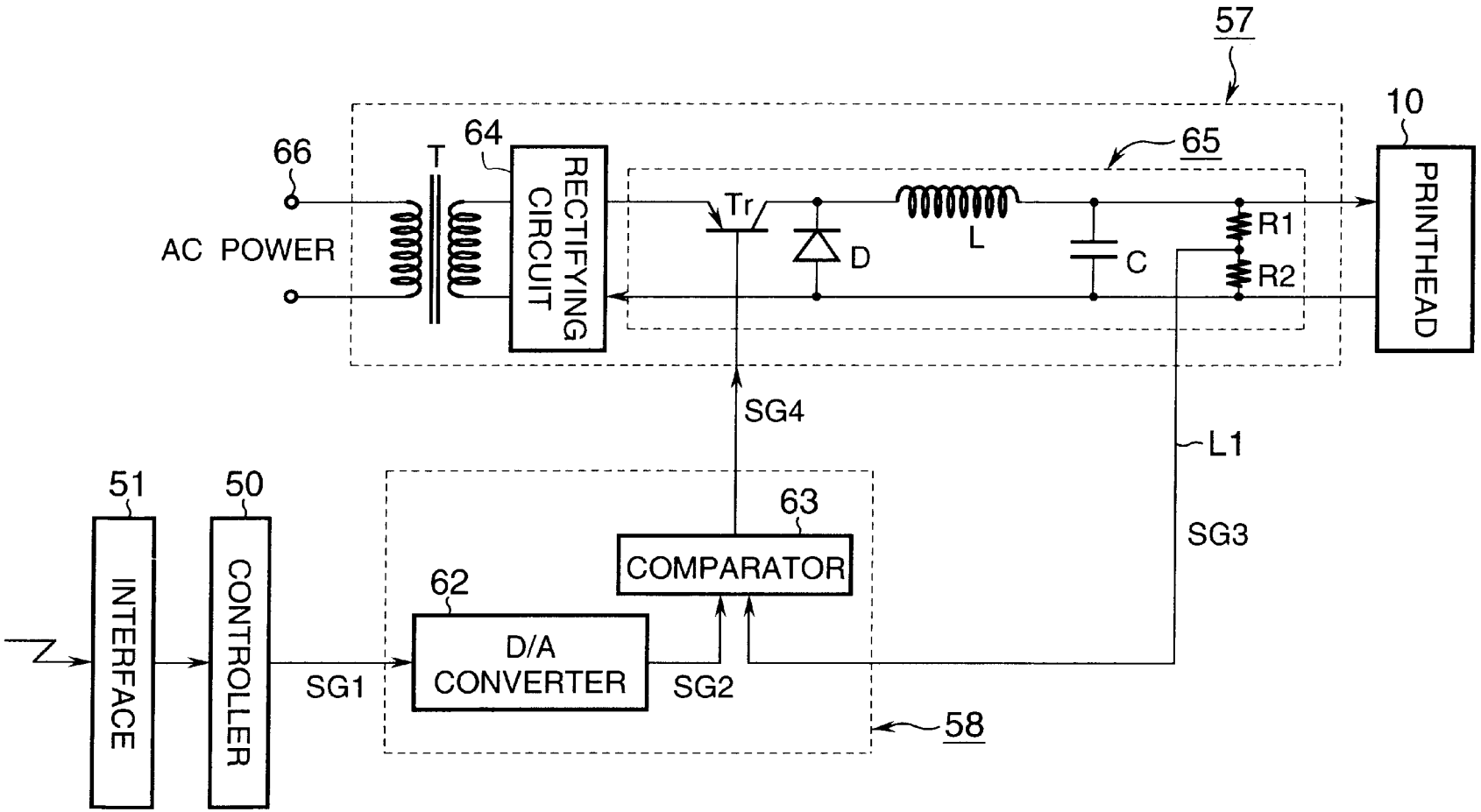
FIG. 6 is a block diagram illustrating a pertinent portion of an ink jet printer according to the second embodiment.

FIG. 6 is a block diagram illustrating a pertinent portion of an ink jet printer according to the second embodiment.

Referring to FIG. 6, the controller 50 receives print data and associated command signals from a host apparatus through the interface 51. A voltage converter 57 includes a transformer T, a rectifying circuit 64, and a switching controller 65. The switching controller 65 includes a transistor Tr, a diode D, an inductor L, a capacitor C, and resistors R1 and R2. The transistor Tr is switched on and off to produce a series of pulse current. The pulse current is smoothed out by the inductor L and capacitor C so that a smoothed-out dc drive voltage is applied to the electrodes of the printhead 10. The information on the smoothed-out dc voltage (SG3) is directed from a junction of the resistors R1 and R2 to a power-supply controller 58.

The power-supply controller 58 includes a D/A converter 62 and a comparator 63. The D/A converter receives the output (SG1) of the controller 50 and provides a signal SG2 to the comparator 63. The comparator 63 compares the output (SG2) of the D/A converter 62 with the voltage (SG3), thereby providing a signal SG4 to the voltage converter 57. The signal SG4 drives the transistor Tr to output pulse current Ii (i=1, 2, 3, . . . ) with different duty cycles.

Figure 7:
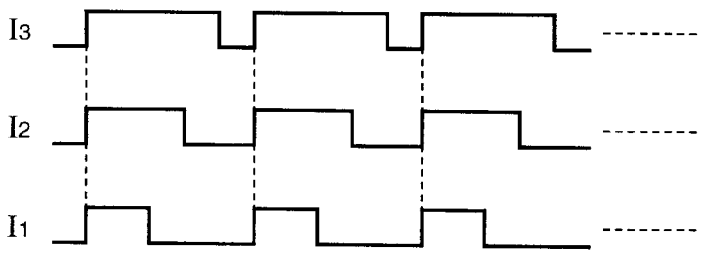
FIG. 7 is a timing chart illustrating the operation of the ink jet printer of the second embodiment.

FIG. 7 is a timing chart illustrating the operation of the ink jet printer of the second embodiment, showing three examples of pulse currents I, I2, and I3 that have larger duty cycles in this order.

The drive voltage applied to the electrodes of the printhead 10 can be changed in accordance with the magnitude of the signal SG1. The controller 50 causes the timer 52 (FIG. 5) to start counting time t shortly after a suction operation of the ink pressure chambers has been performed following the power-up of the printer, and shortly after one printing job has been completed. In the second embodiment, the suction operation is performed only shortly after the power up of the printer Upon receiving a print command, the controller 50 causes a drive voltage to be outputted to the electrodes of the printhead 10, according to the elapsed time t that is counted by the timer 52.

Figure 8:
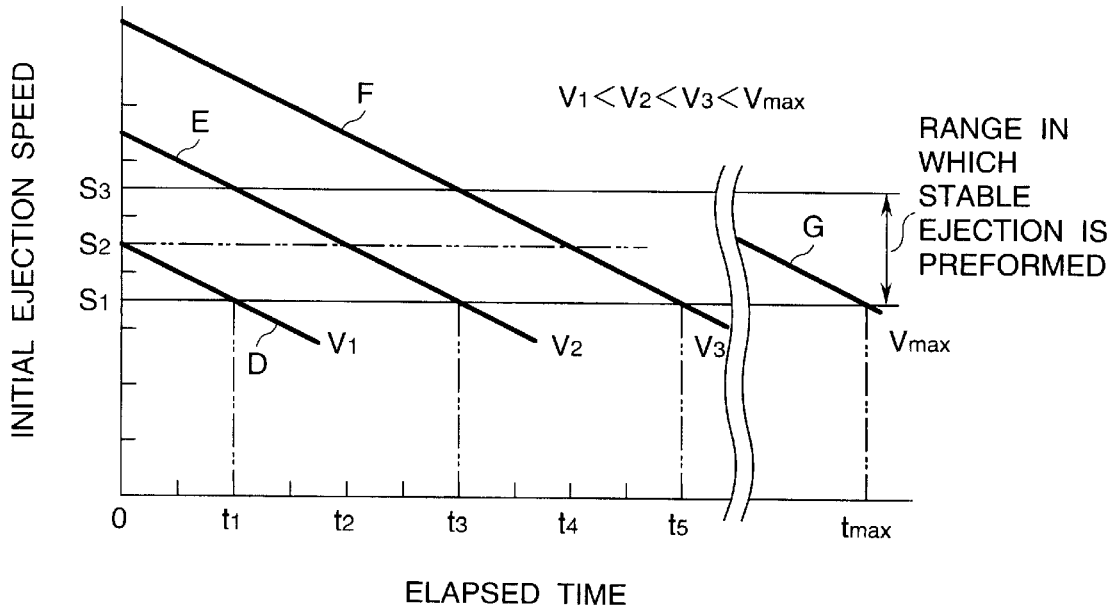
FIG. 8 is a graph illustrating the ejection performance of a printhead.

For this purpose, the table 53 (FIG. 5) lists elapsed times and corresponding drive voltages for ejection test as shown in FIG. 8.

FIG.8 is a graph illustrating the ejection performance of a printhead that has been left capped. Line D shows changes in initial ejection speed when the ejection test is carried out using a drive voltage V1. V1 is the same drive voltage as applied to the electrodes during printing. Line E shows changes in initial ejection speed when the ejection test is performed using a drive voltage V2. Line F shows changes in initial ejection speed when the ejection test is performed using a drive voltage V3. Line G shows changes in initial ejection speed when the ejection test is performed using a drive voltage Vmax, the highest of all voltages applied to the electrodes of the printhead 10. The voltages are selected such that V1<V2<V3<Vmax. The range from s1 to s3 is a range in which normal ejection speed can be recovered if an ejection test is performed.

The ejection test is not performed for an elapsed time t in the range of t<t1.

The ejection test is performed using the drive voltage V2 for an elapsed time t in the range of t1≦t<t3. The ejection test is performed using the drive voltage V3 for an elapsed time t in the range of t3≦t<t5. Likewise, for elapsed times longer than t5, the ejection test is performed using the drive voltage that is increased stepwise with increasing elapsed time.

At time tmax, the ejection test is performed using the Vmax, and then the timer 52 is reset so that the elapsed time t is zero and the ejection test will be performed subsequently using V1, V2, V3, . . . , and Vmax in this order for the above-described respective ranges of elapsed time.

As mentioned above, the ejection test is performed whenever the elapsed time reaches predetermined values, so that there is no chance of the orifices being clogged and poor ejection is prevented. This prevents the throughput of the printer from significantly decreasing. Each ejection test requires ink as little as only several hundred nano liters, minimizing the wasted amount of ink. The ejection test and vibration of meniscuses are effected with the cap 21 intimately fitting to the orifice plate 14, so that the interior of the cap 21 is maintained at high humidity, allowing a longer elapsed time between consecutive ejection tests. This maintains the ejection speed within a reasonable range, so that ink drops ejected from the moving printhead are allowed to accurately land on the print paper at aimed locations.

Since the drive voltage is set to higher values with increasing length of elapsed time, the ejection test is required less frequently, saving a total amount of ink used for ejection test.

Third Embodiment

Elements of a third embodiment similar to those of the first embodiment have been given the same reference numerals and the description thereof is omitted.

Figure 9:
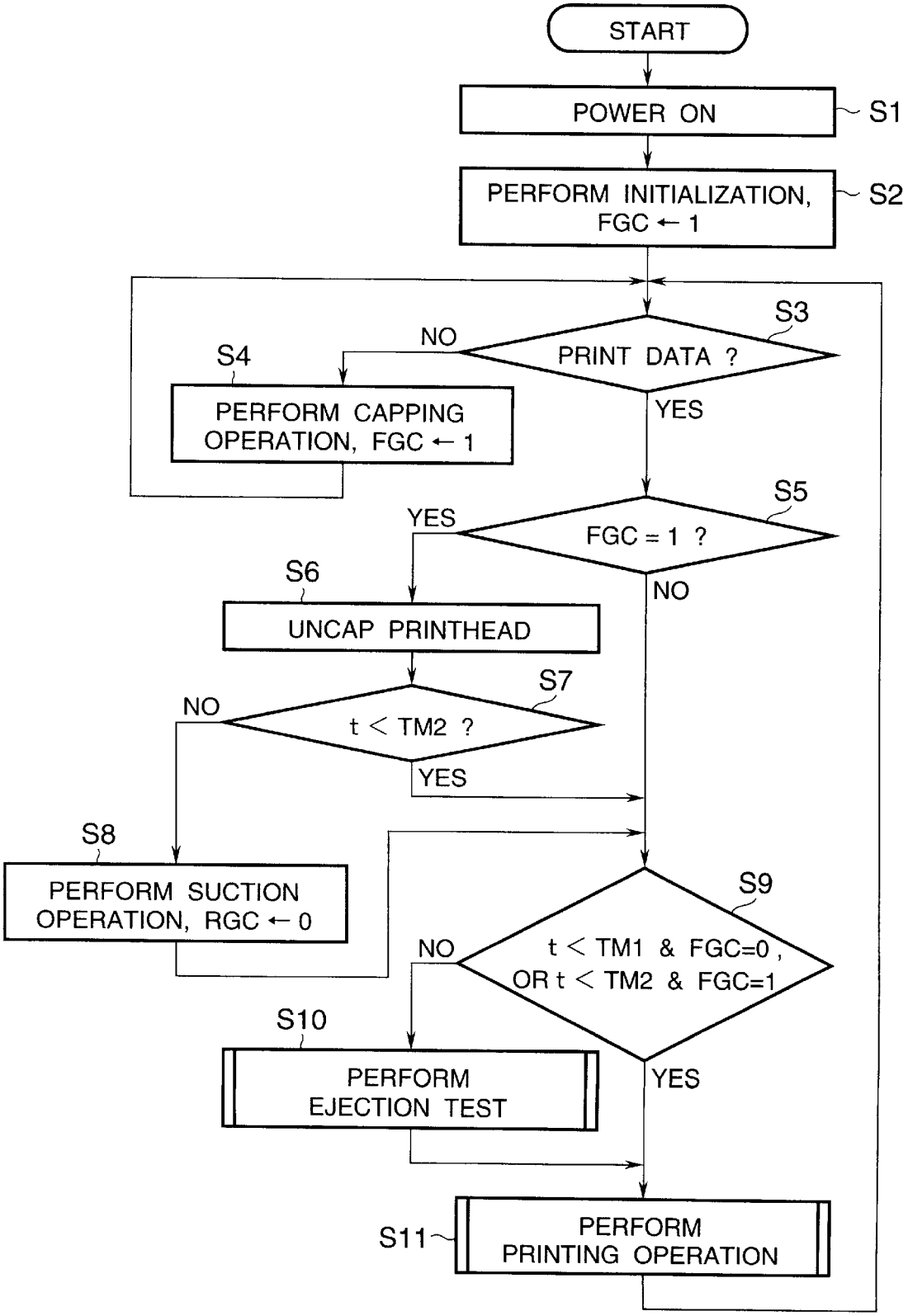
FIG. 9 is a flowchart illustrating the operation of the controller according to the third embodiment.

FIG. 9 is a flowchart illustrating the operation of the controller 50 according to the third embodiment.

In the third embodiment, the term "capping operation" is used to cover a state in which the cap 21 (FIG. 3) remains fitted over the orifice plate 14 of the printhead 10. The term "uncapping operation" to cover a state in which the cap 21 remains removed from the orifice plate 14 so that the orifice plate 14 is exposed.

Upon power-up of the ink jet printer at step S1, the controller 50 causes the timer 52 to start counting and the initialization of the printer is performed at step S2. Upon completion of the initialization, the printer becomes ready for printing. At step S3, a check is made to determine whether print data has been received from a host apparatus. If the answer at step S3 is NO, then the program proceeds to step S4 where a capping operation is performed and flag FGC is set to a logic 1. FGC=1 indicates that the printhead 10 has been capped. Then, the program jumps back to step S3.

If the answer is YES at step S3, the program proceeds to step S5 where a check is made to determine whether the printhead has been capped, i.e., FGC=1. If the answer is YES at step 5, then the program proceeds to step S6 where the uncapping operation is carried out, and the program proceeds to step S7 where a check is made to determine whether the timer 52 has counted up to TM2 or more. If the answer is NO at step S7, then the program proceeds to step S8 where a suction operation is performed, and the flag FGC is set to a logic 0. TM1 is a maximum length of time for which the printhead 10 can be left uncapped before the ejection test or the suction operation should be performed.

If the answer is YES at step S7, then the program proceeds to step S9. At step S9, a check is made to determine whether the flag FGC=0 and the timer 52 has counted up to TM1 or more, or whether the flag FGC=1 and the timer 52 has counted up to TM2 or more. TM1 is a maximum length of time for which the printhead 10 can be left uncapped before the ejection test or the suction operation should be performed. TM2 is a maximum length of time for which the printhead 10 can be left capped before the ejection test or the suction operation should be performed. If the answer at step S9 is NO, then it is determined that a continuous printing is being performed, and the program proceeds to step S11 where the printer continues to print. If the answer at step S9 is YES, then it is determined that the printhead has been left capped, and the program proceeds to step S11 where the printer continues to print. After performing the printing at step S11, the program loops back to step S3. If the answer is NO at step S9, the program proceeds to step S10 where the ejection test is performed, and then the program proceeds to step S11. The printing operation at step S11 is carried out, for example, on a line-by-line basis.

In a color ink jet printer, the printhead includes yellow, magenta, cyan, and black heads and the suction is performed for individual color heads in order. Therefore, a long time should be allowed before all the colorheads have been sucked. As a result, the state of orifices of a first color head will have changed by the time the fourth color head has been sucked.

In order to solve this problem, the ejection test is performed immediately after the suction is performed, thereby maintaining the conditions of orifices of all the color heads at substantially the same conditions.

The value of TM1 is selected to ensure a desired ejection speed during printing, so that print quality is not significantly deteriorated. The value of TM2 is selected to ensure a desired ejection speed when a printing starts, so that ink drops are normally ejected.

If both the TM1 and TM2 are too long, then the viscosity of ink in the ink pressure chamber near the orifices increases correspondingly. In order to recover normal viscosity, a larger number of ink drops should be ejected in one ejection test. An ejection involves very fine ink drops, referred to "satellite droplets" and the satellite droplets may be deposited on the orifice plate. The number of satellite droplets increases with increasing ink drops ejected in one ejection test. Therefore, both the TM1 and TM2 are selected to ensure that the surface of the orifice plate is not contaminated with satellite droplets, and the orifice plate need not be wiped before a first ejection of ink drops.

<Ejection Test>

The subroutine "ejection test" performed at step S10 of FIG. 9 will be described.

Figure 10:
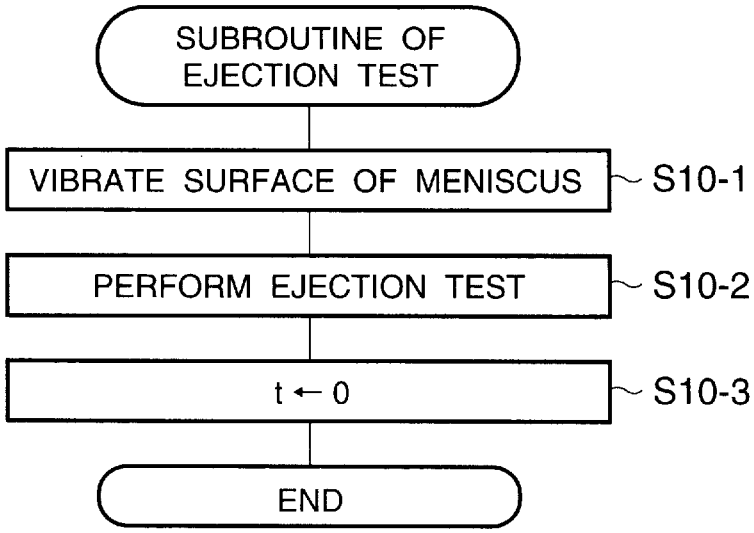
FIG. 10 is a flowchart illustrating the subroutine of the third embodiment.

FIG. 10 is a flowchart illustrating the subroutine of the third embodiment.

At step S10-1, with the cap 21 (FIG. 2) fitting over the orifice plate 14, vibration generating means, not shown, of the controller 50 (FIG. 5) applies pulses of drive voltage. The pulses of drive voltage are not high enough for the ink chambers to eject ink drops through the orifices but high enough to slightly pressurize the ink pressure chambers. As a result, the ink pressure chambers are slightly pressurized, causing very fine vibration of the surfaces of the meniscuses. The vibration frequency is about 8 kHz, equal to the drive frequency when the printhead is normally driven to eject ink drops during printing operation.

The controller 50 performs the ejection test at step S10-2 and then sets the elapsed time t for 0 at step S10-3.

<Vibrating the Surface of Meniscus>

Figure 11A:
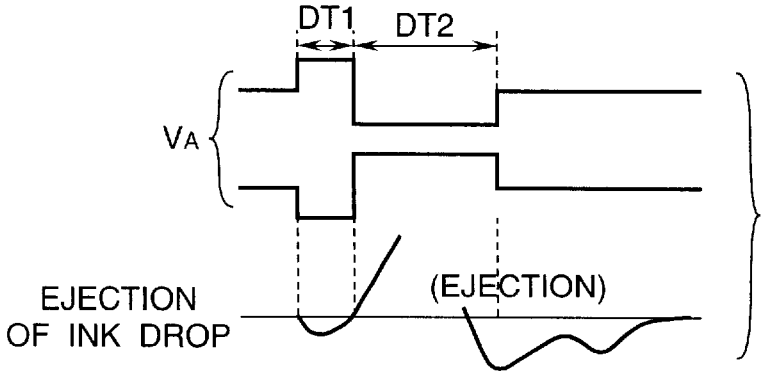
FIGS. 11A and 11B are timing charts showing the waveforms of signals of the third embodiment when the printing operation is performed and the waveforms of signals when the ejection test is performed.
Figure 11B:
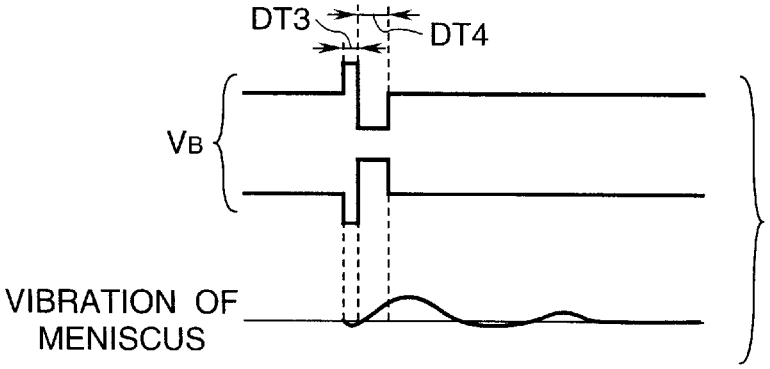

FIG. 11A is a timing chart showing the waveforms of signals when the printing operation is performed and FIG. 11B is a timing chart showing the waveforms of signals when the ejection test is performed.

A drive voltage $V_A$ for the normal printing operation has long periods DT1 and DT2 so that the surfaces of meniscuses vibrate with large amplitudes to eject an ink drop. A drive voltage $V_B$ for vibrating the surface of meniscus has short periods DT3 and DT4 so that the surface of the meniscus vibrates with a small amplitude and therefore no ink drop is ejected. FIG. 11B shows the waveforms corresponding to one of a plurality of drive pulses applied to the printhead during vibration of meniscuses. According to the third embodiment, the surface of the meniscus is caused to vibrate immediately before the ejection test so as to well mix high-viscosity ink near the orifice with normal-viscosity ink in the ink pressure chamber. Thus, the viscosity of ink near the orifice is decreased. The fine vibration of meniscuses allows the ejection test to be performed using low-viscosity ink, saving the amount of ink used during ejection test.

The meniscuses may also be subjected to fine vibration at predetermined intervals during the printing operation, thereby preventing the viscosity of ink near the orifices from increasing.

Figure 12:
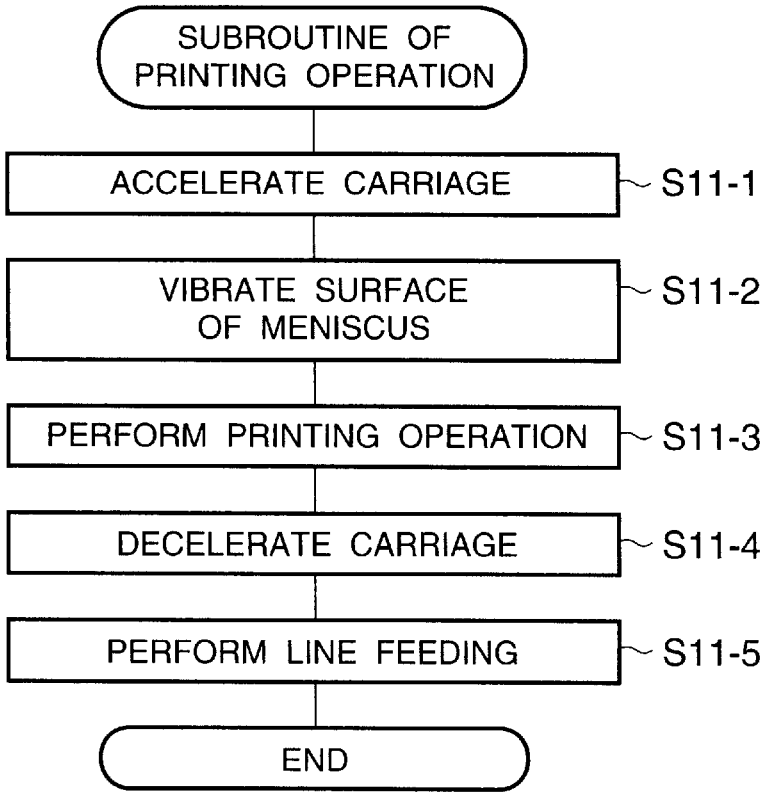
FIG. 12 is a flowchart illustrating the subroutine for the printing operation performed at step S11 of FIG. 10.

FIG. 12 is a flowchart illustrating the subroutine for the printing operation performed at step S11 of FIG. 9.

The subroutine will now be described with reference to FIG. 12.

The controller 50 (FIG. 5) accelerates a carriage, not shown, at step S11-1. With the cap 21 (FIG. 1) fitting over the orifice plate, the controller 50 applies pulses of drive voltages at step S11-2, the drive voltages being not high enough for the ink chambers to eject ink drops through the orifices but high enough for pressurizing the ink pressure chambers slightly. As a result, the ink pressure chambers are slightly pressurized, causing very fine vibration of the surfaces of the meniscuses. The vibration of meniscuses is continued until just before the printing operation is started after the carriage has reached a constant speed.

Then, the controller 50 performs a printing operation of one line at step S11-3. Then, the carriage is decelerated at step S11-4 before line-feeding at step S11-5.

The meniscuses may also be subjected to fine vibration not only during the acceleration of the carriage but during the deceleration of the carriage and line-feeding.

Further, the meniscuses may also be subjected to fine vibration when a printing is not being performed, for example, when print data is being received form the host apparatus.

As described above, in the third embodiment, the meniscuses are subjected to fine vibration at predetermined timings according to the flowchart, of FIG. 12. This reduces the number of ejection tests (step S10) and the number of suction operations (step S8), saving a total amount of ink not used directly for printing.

Figure 13:
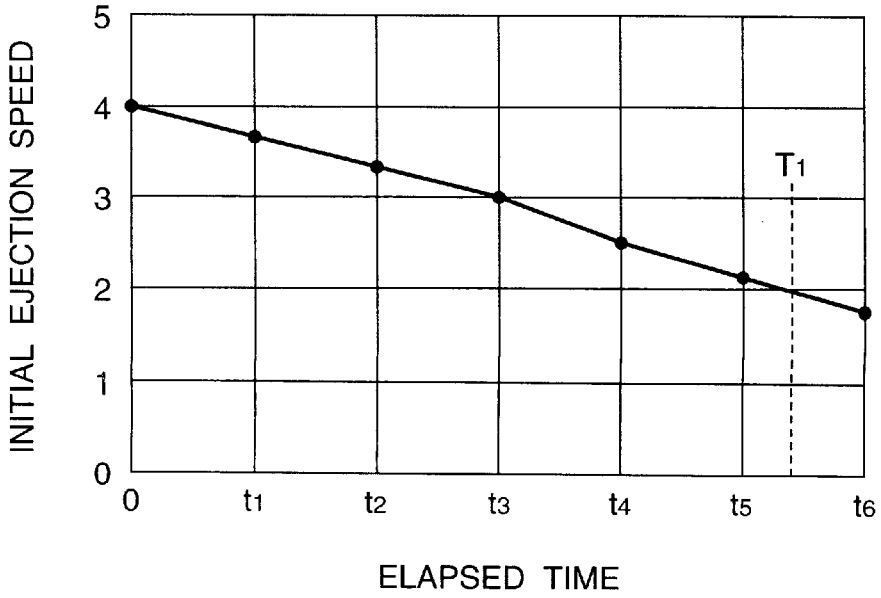
FIG. 13 is a graph illustrating ejection performance of a printhead according to the third embodiment in which the meniscuses are subjected to fine vibration without the printhead capped.

FIG. 13 is a graph illustrating ejection performance of a printhead according to the third embodiment in which the meniscuses are subjected to fine vibration without the printhead capped.

Figure 14:
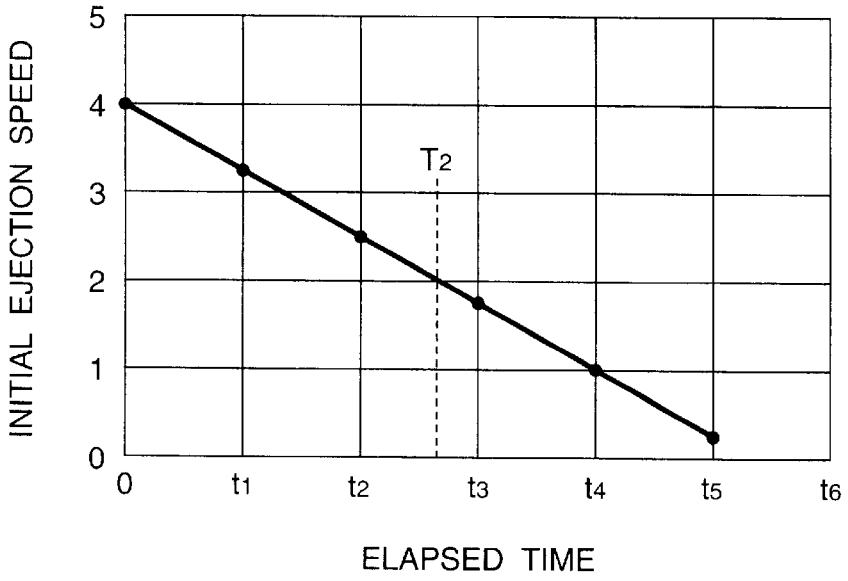
FIG.14 CONVENTIONAL ART
FIG. 14 is a graph illustrating ejection performance of a conventional printhead in which the meniscuses are not subjected to fine vibration.

FIG. 14 is a graph illustrating ejection performance of a conventional printhead in which the meniscuses are not subjected to fine vibration.

FIGS. 13 and 14 plot the elapsed time as the abscissa and the initial ejection speed as the ordinate.

When the printhead 10 (FIG. 5) is capped, FIGS. 13 and 14 show the same initial ejection speed V1 at time t=0. However, the elapsed time t at which the initial ejection speed S reaches a minimum value S2 is T1 in FIG. 13, which is about twice that T2 of FIG. 14.

Therefore, the time TM1, a maximum time length for which the printhead 10 can be left uncapped can be increased by a factor of two. As a result, the orifices are not clogged and ejection performance is not deteriorated over a long term without having to perform test the ejection and suction operation. Moreover, this reduces the number of ejection tests and the number of suction operations, thereby improving print throughput and consuming less ink.

With the printhead 10 capped, subjecting the surfaces of meniscuses to fine vibration just before the ejection test increases the TM2, a maximum time length for which the printhead 10 can be left capped before an ejection test or a suction operation should be performed. As a result, the orifices are not clogged and the ejection performance is not deteriorated over a long term without having to perform the ejection test and suction operation. Moreover, this reduces the number of ejection tests and the number of suction operations, thereby improving print throughput and consuming less ink.

Fourth Embodiment

A fourth embodiment differs from the second embodiment in that the surfaces of meniscuses are subjected to fine vibration and a table that lists correction voltage for drive voltage is provided. Elements similar to those of the second embodiment have been given the same reference numerals and the description thereof is omitted.

Figure 15:
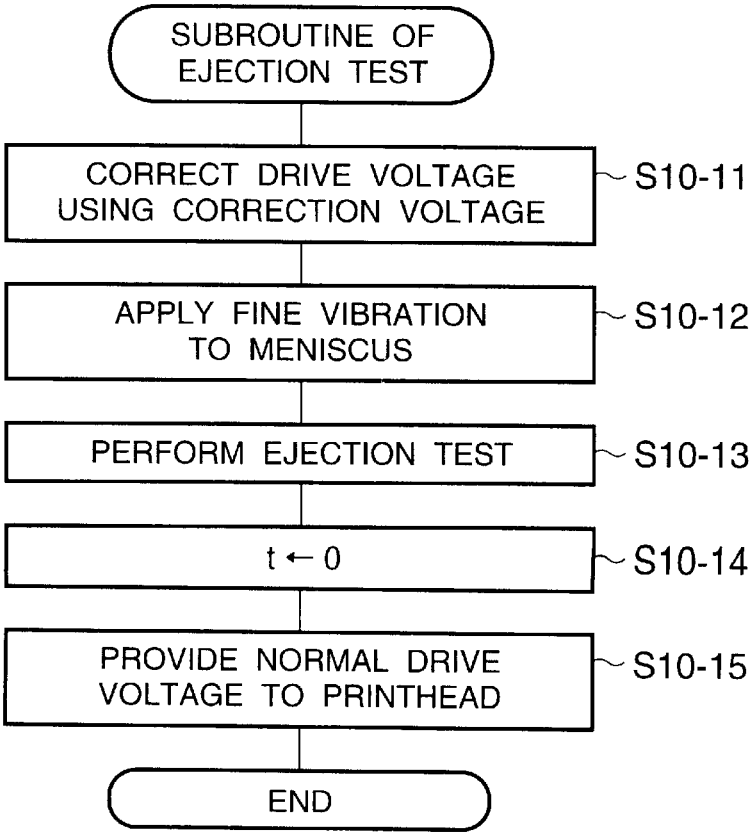
FIG. 15 is a flowchart illustrating the subroutine of an ejection test according to a fourth embodiment.

FIG. 15 is a flowchart illustrating the subroutine of an ejection test according to a fourth embodiment.

Figure 16:
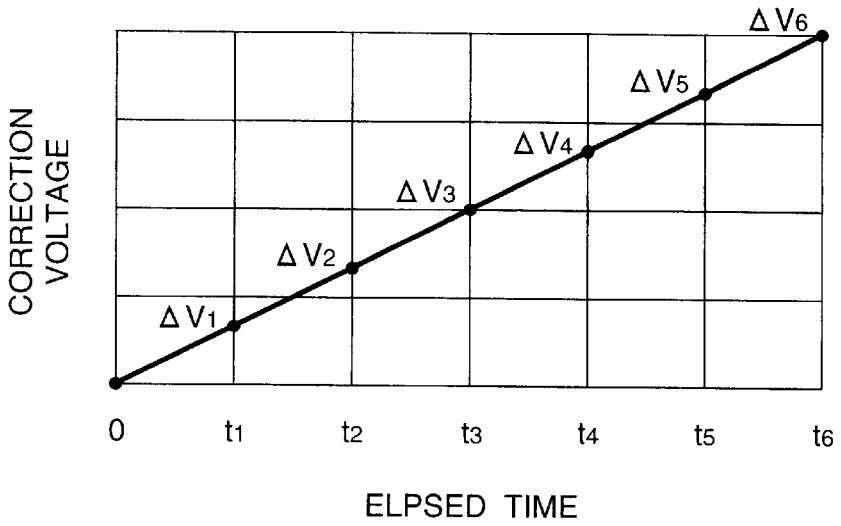
FIG. 16 shows correction voltages of the fourth embodiment.

FIG. 16 shows correction voltages of the fourth embodiment, plotting the elapsed time t as the abscissa and the correction voltage as the ordinate.

In the fourth embodiment, the table 53 (FIG. 5) lists correction voltages ΔV1–ΔV6 for corresponding elapsed times t1–t6 as shown in FIG. 16.

The controller 50 (FIG. 6) reads a correction voltage ΔVi (i=1, 2, 3, . . . ) corresponding to an elapsed time ti_(i=1, 2, 3, . . . ) from the table 53, and adds the correction voltage ΔVi to the drive voltage used for printing operation to produce a drive voltage that is applied to the electrodes of the printhead 10 during the ejection test.

As shown in FIG. 16, the correction voltage ΔVi becomes high with increasing elapsed time t but is selected to be low enough such that the transistor Tr of FIG. 6 can withstand.

<Vibrating the Surface of Meniscus>

The controller 50 applies the drive voltage to the printhead 10 with the cap 21 (FIG. 2) fitting over the orifice plate 14, the drive voltage being high enough to slightly pressurize the ink pressure chambers but not high enough for the ink pressure chamber to eject ink drops. The drive voltage causes the surfaces of meniscuses in the orifices to vibrate with small amplitudes. The drive voltage used for vibrating the surface of meniscus may also be corrected using the correction voltage ΔVi in the table 53.

Subsequently, the controller 50 performs the ejection test and subsequently resets the timer 52 such that the elapsed time t is zero after the ejection test. Then, the controller 50 provides a drive voltage for the normal printing operation to the printhead 10. This drive voltage is determined taking environmental factors such as ambient temperature and humidity into account since the viscosity of ink changes with ambient temperature and humidity.

Figure 17:
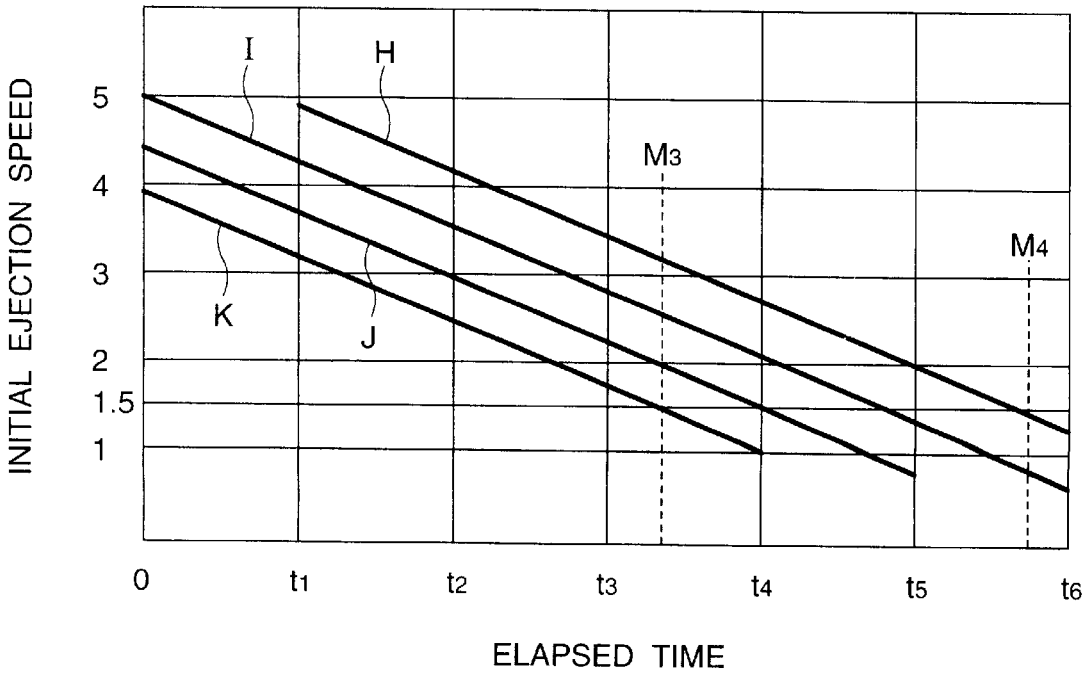
FIG. 17 is a graph illustrating the ejection performance of the fourth embodiment.

FIG. 17 is a graph illustrating the ejection performance of the fourth embodiment when the printhead is left uncapped, plotting the elapsed time as the abscissa and the initial ejection speed as the ordinate. FIG. 17 illustrates initial ejection speeds when the drive voltage is corrected using the correction voltages of FIG. 16.

Lines H to L are substantially parallel with one another. The initial ejection speed increases with increasing correction voltage.

Line K shows initial ejection speeds when the correction voltage ΔVi is zero. We assume that a lower limit of the initial ejection speed is 1.5, then the maximum length of time for which the printhead 10 can be left uncapped is M3. Line H shows initial speeds when the correction voltage ΔVi=ΔV6. Lines I and J show initial ejection speeds when the correction voltages ΔVi is ΔV4 and ΔV2, respectively. It is to be noted that the maximum length of time for which the printhead can be left uncapped is M4, clearly longer than M3. Therefore, the orifices can be free from clogging and poor ejection performance for a longer time before the ejection test and/or suction operation should be performed. The fourth embodiment requires less frequent ejection test and suction operation, increasing the throughput of the printer as well as saving ink.

FIG. 15 is a flowchart illustrating the operation of the fourth embodiment.

At step S10-11, the controller 50 corrects the drive voltage using the correction voltage according to the elapsed time. At step S10-12, the controller applies fine vibration to the meniscuses. At step S10-13, the controller 50 performs the ejection test. At step S10-14, the controller 50 sets the timer 52 for zero (elapsed time t=0). At step S10-15, the controller 50 provides the drive voltage to the printhead 10 for the normal printing operation.

In the fourth embodiment, the drive voltage for the ejection test is set higher than the drive voltage for the normal printing operation. As a result, a very satisfactory ejection test can be performed from the beginning of the first ejection test. However, for the second ejection test and onward, the ejection speed increases with increasing number of ejection tests if the same corrected drive voltage is used.

The ejection characteristic after a certain length of time has passed will be described.

Figure 18:
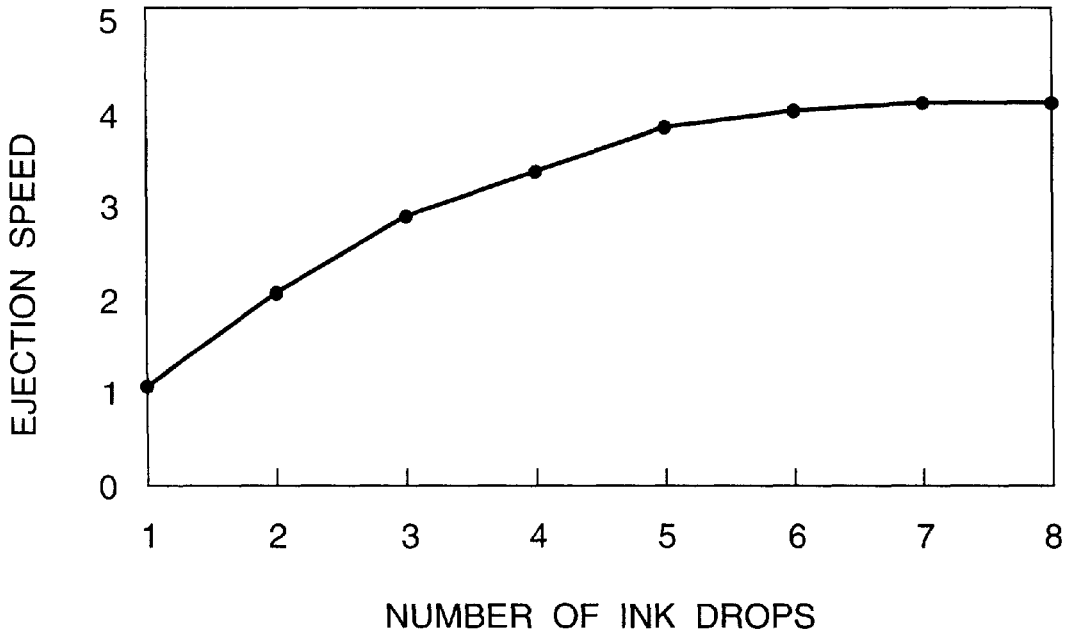
FIG. 18 illustrates the ejection characteristic of the printhead after a predetermined length of time has elapsed.

FIG. 18 illustrates ejection characteristic of the printhead when the ejection test is performed after a certain length of time has passed with no printing performed. FIG. 18 plots the number of ejection or ink drops as the abscissa and the ejection speed as the ordinate.

Referring to FIG. 18, the ejection speed is very low at the first ejection but increases with increasing number of ink drops, reaching a steady value after the ejection of seven ink drops.

When the ejection speed exceeds a certain value, larger ink drops are ejected resulting in many satellites droplets that float in the air. The satellite droplets are then deposited on the orifice plate, eventually affecting the ejection speed. This indicates that there is a maximum number of times that the ejection test can be performed with corrected drive voltage. Beyond the maximum number of times, high viscosity ink near the orifices cannot be ejected satisfactorily. This problem can be solved by using a drive voltage that is corrected with smaller correction voltages that decreases with increasing ink drops in each ejection of ink drop.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An apparatus for driving a printhead, comprising:

a power supply that provides a drive voltage to the printhead, the printhead having an orifice through which an ink drop is ejected when the drive voltage is applied to the printhead; and a controller that causes said power supply to apply the drive voltage to the printhead, said controller controlling the drive voltage such that a surface of a meniscus of ink in the orifice is subjected to fine vibration prior to entering an ink ejection operation.

2. The apparatus according to claim 1, wherein the surface of the meniscus is subjected to fine vibration prior to a printing operation.

3. The apparatus according to claim 1, wherein the surface of the meniscus is subjected to fine vibration prior to an ejection test.

4. The apparatus according to claim 1, wherein when an ejection test is performed, said controller determines the drive voltage by adding a first correction voltage to a drive voltage required for a printing operation.

5. The apparatus according to claim 1, wherein when the surface of meniscus is subjected to fine vibration, said controller determines the drive voltage by adding a second correction voltage to a drive voltage required for a printing operation.

6. The apparatus for driving a printhead according to claim 1, wherein the fine vibration is performed with the drive voltage varied in accordance with an elapsed time during which the printhead is not driven.

7. An apparatus for driving a printhead, comprising:

a timer that counts at least one of a time elapsed after power up until printing is performed for a first time after the power up, and a time elapsed after a most recent printing operation;

a drive source that applies a drive force to the printhead; and a controller that performs an ejection test where the printhead is driven by the drive force a plurality of times to eject a plurality of ink drops, said controller driving said drive source to increase the drive force in accordance with an increase in a length of the time.

8. The apparatus according to claim 7, wherein said drive source is a power supply that applies a drive voltage to the printhead, the drive voltage being changed to change the drive force.

9. The apparatus according to claim 8, wherein the drive voltage is selected from predetermined voltages in accordance with a decrease in an ejection speed of the ink drops resulting from the time.

10. The apparatus according to claim 8, wherein the drive voltage is such that an ejection speed of the ink drops is within a certain range.

11. The apparatus according to claim 8, wherein said controller causes said power supply to output the drive voltage, the drive voltage being changed in accordance with an output of said timer when said controller receives a print command.

12. The apparatus according to claim 7, wherein said timer starts to count the time when an initialization of the apparatus is performed after power up.

13. The apparatus according to claim 7, wherein said timer starts to count the time immediately after completion of a printing operation.

14. The apparatus according to claim 13, wherein said controller causes said drive source to output the drive force, the drive force being changed in accordance with an output of said timer when said controller receives a print command.

15. A method of driving a printhead, comprising:

driving the printhead to eject ink drops through orifices of the printhead to perform a printing operation when print data is received;

counting at least one of a time elapsed after power up until printing is performed for a first time after the power up, and a time elapsed after a most recent printing operation; and performing an ejection test in which the printhead is variably driven in accordance with a length of the time.

16. The method according to claim 15, wherein the ejection test is performed before the elapsed time exceeds a maximum value below which the printhead ejects ink drops at speeds within a predetermined range.

17. The method according to claim 15, wherein during the ejection test, the printhead is driven by a drive voltage determined in accordance with the elapsed time.

18. A method of driving a printhead, comprising:

driving the printhead to eject ink drops through orifices of the printhead to perform a printing operation when print data is received;

counting an elapsed time during which the printhead is not driven; and performing an ejection test with different drive forces in accordance with a length of the elapsed time.

* * * * *